US006705480B1

(12) United States Patent
Saddler

(10) Patent No.: US 6,705,480 B1
(45) Date of Patent: Mar. 16, 2004

(54) ATTACHMENT FOR PAINT CAN

(76) Inventor: Garry A. Saddler, 27 Crombie Street, P.O. Box 1030, Seaforth, Ontario (CA), N0K 1W0

( * ) Notice: Subject to any disclaimer, the term of this patent is extended or adjusted under 35 U.S.C. 154(b) by 0 days.

(21) Appl. No.: 10/453,363

(22) Filed: Jun. 3, 2003

(51) Int. Cl.[7] ..... B65D 25/40; B65D 35/38

(52) U.S. Cl. ..... 220/4.03; 220/700; 220/701; 222/570

(58) Field of Search ..... 220/4.03, 8, 699, 220/700–702; 222/570, 566

(56) References Cited

U.S. PATENT DOCUMENTS

| | | | | | |
|---|---|---|---|---|---|
| 2,546,040 | A | | 3/1951 | Murray | 222/570 |
| 2,601,190 | A | | 6/1952 | Wells | 220/90 |
| 2,627,367 | A | | 2/1953 | Bork | 222/570 |
| 2,720,346 | A | | 10/1955 | Compton | 222/570 |
| 2,817,464 | A | | 12/1957 | Schugeld | 222/465 |
| 2,911,016 | A | * | 11/1959 | Kenney | 141/328 |
| 3,252,635 | A | | 5/1966 | Rosenhan | 222/527 |
| 3,366,272 | A | | 1/1968 | Ballmann | 220/90 |
| 3,595,431 | A | | 7/1971 | Bird | 220/90 |
| 3,788,107 | A | | 8/1975 | Gaal | 222/570 |
| 3,899,107 | A | * | 8/1975 | Gaal | 222/570 |
| D249,645 | S | | 9/1978 | Tedesco | D9/289 |
| 4,316,560 | A | * | 2/1982 | Carter | 222/567 |
| D269,596 | S | | 7/1983 | Fowkes | D9/447 |
| D288,535 | S | | 3/1987 | Bozich | D9/447 |
| 4,852,755 | A | * | 8/1989 | Michel et al. | 220/4.03 |
| 5,022,546 | A | * | 6/1991 | Bock | 220/4.03 |
| D328,864 | S | | 8/1992 | Grunzweig | D9/447 |
| 5,213,239 | A | | 5/1993 | Macaluso | 222/570 |
| 5,913,450 | A | * | 6/1999 | Runkel | 220/696 |

* cited by examiner

*Primary Examiner*—Joseph Man-Fu Moy
(74) *Attorney, Agent, or Firm*—Gifford, Krass, Groh, Sprinkle, Anderson & Citkowski, P.C.

(57) ABSTRACT

Provided is a pouring attachment for a paint container. The container has a peripheral side wall extending upwardly to an upper peripheral annular rim which defines a container opening. The attachment comprises an annular attachment body having an inner surface and an outer surface and a bottom edge portion sealingly engageable with the annular rim. The attachment body is funnel shaped, extending upwardly and outwardly from the bottom portion to an upper edge of the body. Releasable clip members pivotally secured to the inner surface of the attachment body can be used to releasably lock the bottom portion of the attachment body to the rim in a sealing manner, thereby allowing the liquid to be poured out via said attachment. The clip members secure the attachment to the rim with sufficient strength so as to prevent inadvertent/accidental detachment of the attachment. Preferably there are two clip members each having a clip body and a clip latch extending downwardly from the clip body and pivotally connected thereto.

20 Claims, 4 Drawing Sheets

ATTACHMENT FOR PAINT CAN

FIELD OF THE INVENTION

This invention relates to painting products and in particular to an attachment for paint containers.

BACKGROUND OF THE INVENTION

It is known to provide funnel shaped attachments adapted for mounting on the annular rim of paint cans in sealing engagement therewith. However, the paint container attachments of the prior art are not engaged to the can with a sufficiently secure attachment to prevent accidental/inadvertent disengagement of the sealing attachment from the can. For example, U.S. Pat. No. 3,899,107 issued Aug. 12, 1975 to Gaal discloses a generally funnel-shaped attachment for the top of a paint can which is designed to cover the groove formed in the top of the can. The device of the Gaal Patent relies upon a resilient snap fit retainer section that fits around the upper edge of the can to secure the attachment to the can.

U.S. Pat. No. 2,601,190 issued Jun. 17, 1952 to Wells teaches an annular paint can splash protector attachment that extends around and is attached to the top of a paint can. The splash protector of this device includes an inner skirt that extends into the can a short distance. The protector is secured in position on the can by means of a wire bail having its opposite terminals deflected outwardly to form trunnions for projection through openings in the skirt for engaging beneath and interlocking with the rim of the can. This form of attachment may become inadvertently/accidentally disengaged if the wire bail is deformed.

U.S. Pat. No. 3,366,272 to Ballmann discloses a funnel-shaped attachment that attaches in a sealing manner to the top of a paint can. A flat rubber gasket is mounted in a horizontal shoulder of the attachment and fits into the upper annular groove of the paint can, shielding this groove from the paint. This attachment is secured to the top of the can by an elastic band which is mounted on the downwardly extending outer wall of the attachment. This band frictionally secures the member to the wall of the paint can. It is an object of the invention to provide an improved attachment for a paint can or other container that can be securely attached to the can or container.

SUMMARY OF THE INVENTION

In accordance with an aspect of the invention, there is provided an attachment for a container for storing liquid, the container having a bottom and a peripheral side wall extending upwardly from the bottom to an upper peripheral annular rim that projects horizontally inwardly and defines a container upper opening. The attachment comprises an attachment body having an inner surface and an outer surface and a bottom edge portion engageable with the annular rim. The attachment body extends upwardly and outwardly from the bottom edge portion to an upper edge of the body. Releasable fastener means for connecting and locking the rim to the attachment body in a tight-fitting manner are provided. The fastener means are mounted on the attachment body and are located substantially within the attachment body. Use of the attachment on a container allows the liquid to be poured out of the container via the attachment. The fastener means can connect the attachment body to the rim by engaging the rim from below.

The preferred attachment is secured to the liquid container such as a standard paint can by releasable clip members which prevent inadvertent/accidental detachment of the tight-fitting engagement between the attachment body and the container.

According to another aspect of the invention, a pouring device is provided for a liquid container having an opening in a top of the container, the opening being surrounded by an inwardly projecting rim of the container. The pouring device comprises an annular body having an inner surface, an outer surface, and a bottom edge portion tightly engageable with the rim of the container during use of the pouring device. The annular body slopes upwardly and outwardly from the bottom edge portion to an upper edge of the body. Releasable clip members are movably mounted on the annular body and are adapted to connect the annular body to the rim so that the bottom edge portion tightly engages the rim when the pouring device is used. When the pouring device is attached to the container, liquid can be poured from the container via the pouring device.

BRIEF DESCRIPTION OF THE DRAWINGS

A preferred embodiment of the invention will now be described, by way of example, with reference to the accompanying drawings, in which.

DETAILED DESCRIPTION OF THE PREFERRED EMBODIMENTS

Figure 1:
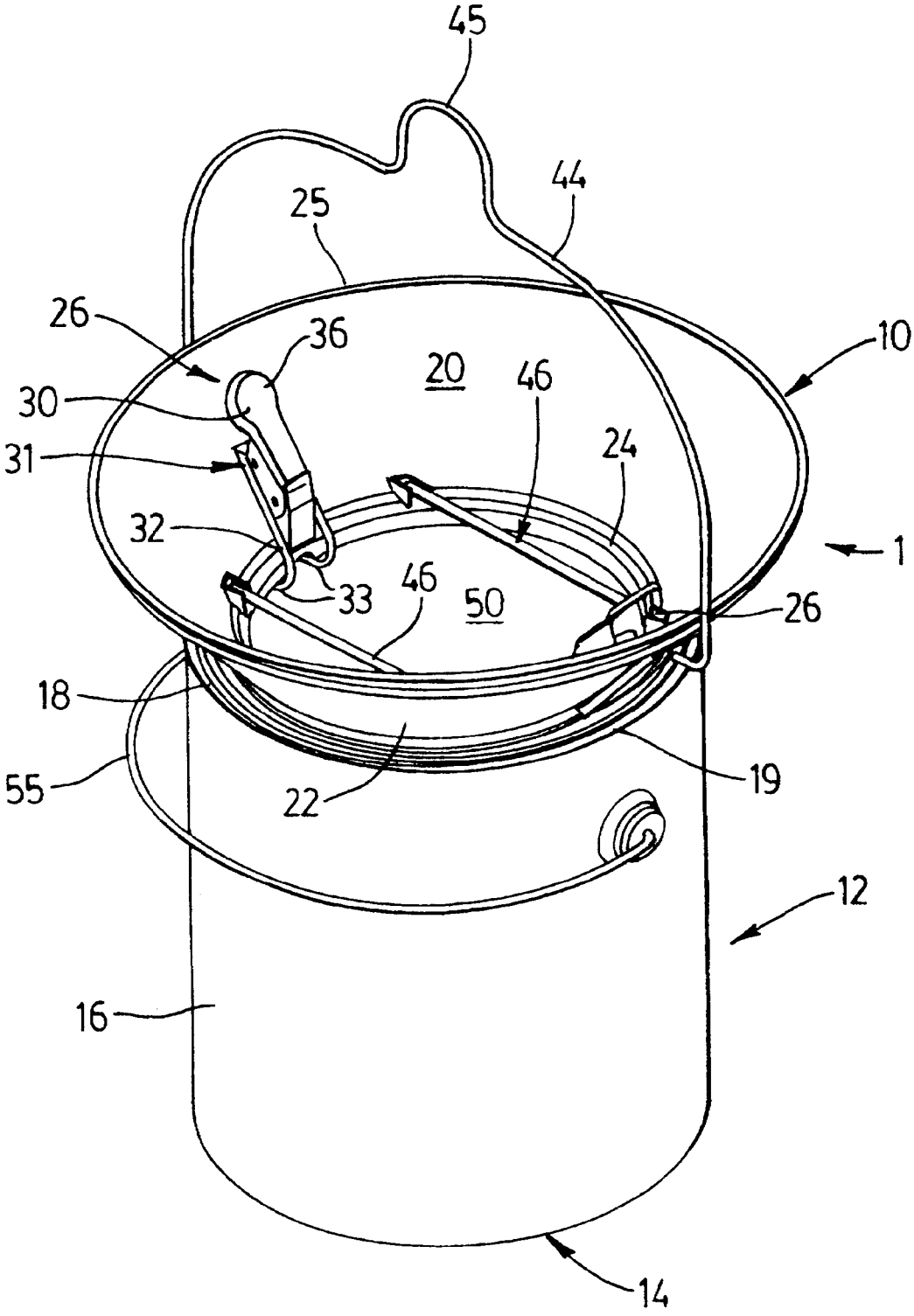
FIG. 1 is a perspective view of a standard paint can fitted with the attachment in accordance with the invention in the locking position.

As shown in FIGS. 1 to 5, the attachment or pouring device of the present invention is indicated generally by reference 1. The attachment 1 is adapted to be secured upon a container, such as a standard paint can 12 having a bottom wall 14 and a peripheral side wall 16 extending upwardly from the bottom wall to an upper peripheral annular rim 18 defining a container upper opening 50.

The attachment includes an attachment body 10 having an inner surface 20, an outer surface 22 and a bottom edge portion 24 which is sealingly engaged to the annular rim 18. The attachment body 10 is preferably funnel shaped, extending upwardly and outwardly from the bottom portion 24 to an upper edge 25.

Figure 4:
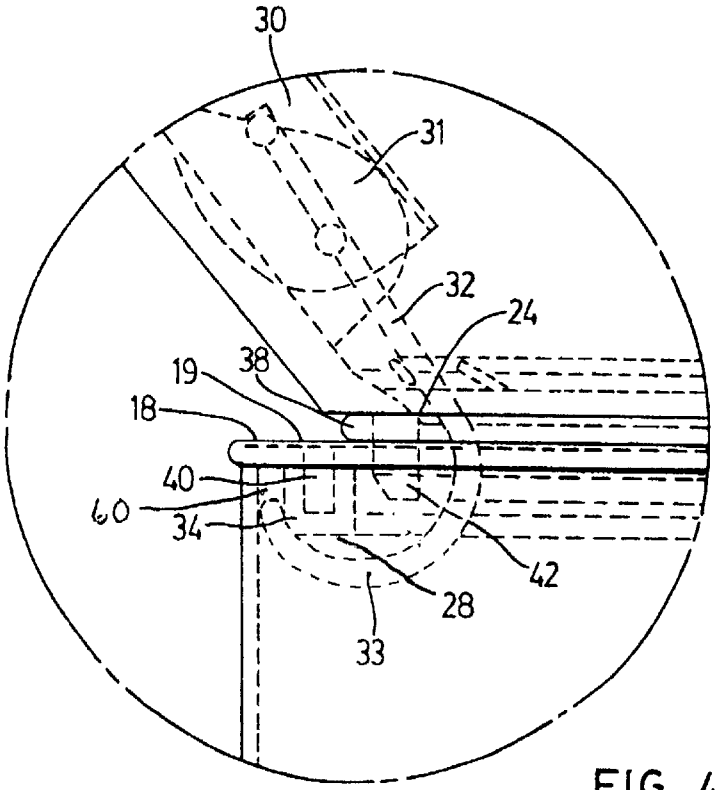
FIG. 4 is a detail view taken in the chain dotted circled area marked with a capital A in FIG. 3.
Figure 3:
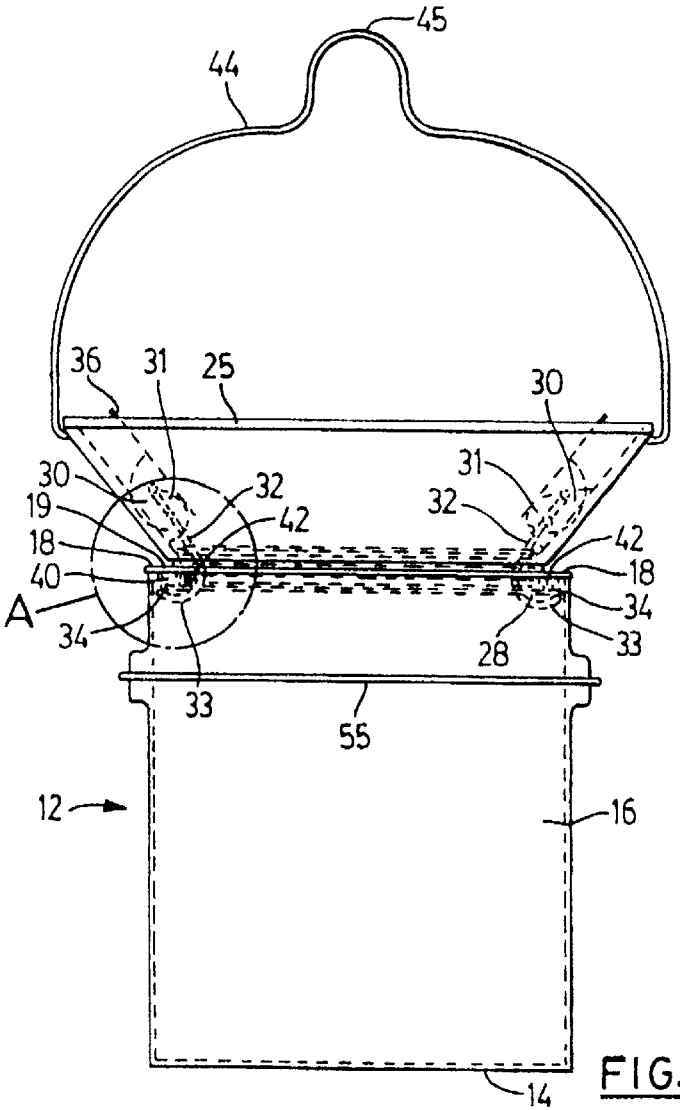
FIG. 3 is a front side view of the preferred embodiment of the attachment of the invention attached to a standard paint can.
Figure 5:
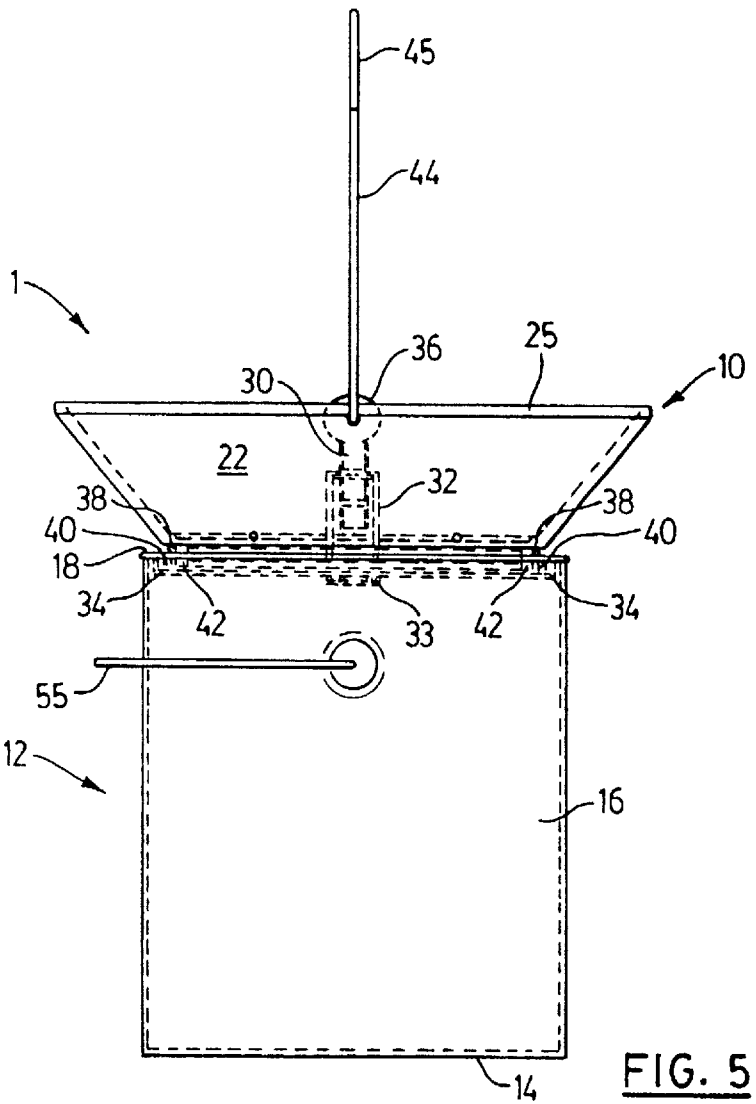
FIG. 5 is a side view taken from the right side of FIG. 3 of the attachment of the invention and a standard paint can.

Releasable clip means releasably lock the rim to the attachment body in sealing engagement therewith, allowing the liquid to be poured out via the attachment. The preferred clip means is at least one clip member 26, and preferably two clip members 26 on opposing sides of the attachment body. The rim 18 includes an inwardly disposed bottom edge 28. Clip members 26 are pivotally secured to the inner surface 20 of the attachment body. Each preferred clip member 26 includes a clip body 30 being pivotally mounted on a support bracket 31 fixedly mounted on the inner surface 20 of the attachment body, and a clip latch 32 extending downwardly from the clip body 30 and pivotally mounted thereto. In the locking position, best seen in FIGS. 3 to 5, the clip latch 32 firmly engages the annular rim from below thereby securing the body to the rim. The latch 32 can engage a bottom edge 28 of the rim. Preferably (and as shown in FIG. 4) the clip latch extends into an annular groove 60 formed outwardly from a downwardly disposed flange 34 of the rim when the clip member is in the locked position. This ensures a very secure connection to the paint can. More particularly, the clip latch 32 is formed of a u-shaped steel wire having two terminal ends, each end pivotally secured to side portions of the clip body 30. The clip latch 32 includes an upwardly hooked bottom end portion 33. The bottom edge 28 of the annular rim 18 includes the downwardly disposed flange 34 under which the hooked portion 33 is positioned when said clip member is in said locking portion. The clip body 30 can be formed of a bent steel plate, and includes an upper circular tab 36, which is spaced sufficiently inwardly from the inner side of the attachment body and the upper edge 25 in the locking position, to allow a finger of a user to fit between the inner side 20 and the tab 36 to pull the tab inwardly from the locking position to release the latch 32 from the bottom edge of the rim 18 and thus allow the attachment body to be separated from the paint can rim 18. It will be appreciated that the clip body 30 being pivotally attached to the clip latch 32 forms an over-centre mechanism to firmly attach the clip latch 32 to the bottom edge of the paint can rim when the clip body is pivoted into the locking position.

The Figures illustrate a preferred embodiment of the clip or fastener means by way of example only. Thus it should be understood that other forms of attachment could also be used instead of the specific embodiment of clip members 18 shown and described. Any suitable releasable fastener or clip can be secured to the attachment body 10, and movable between the locking position where the fastener or clip securely fastens or clips the attachment body 10 to the rim in sealing engagement therewith, and a release position where the rim and attachment body can be separated. For example, suitable clamping means can be used as the fastener(s) to secure the attachment body to the container.

Sealing engagement between the attachment body 10 and the paint can annular rim 18 is achieved by means of a rubber or rubber-like seal disposed between the bottom edge portion 24 of the body and the rim 18. This annular seal is preferably in the form of an O-ring indicated at 38 and seen most clearly in FIG. 4. Preferably, the bottom edge portion of the attachment body forms a skirt 42 extending inwardly of and below the upper annular edge 19 of the annular rim 18. Preferably, the seal is mounted on the downwardly facing outer surface 22 of the bottom edge portion 24 of the attachment body. Thus the seal is arranged between this outer surface and the upper, annular edge 19 of the rim 18. The annular rim defines an upper annular recess 40, adapted to accept a downwardly disposed mating tongue of a lid (not shown) for the container. Preferably, the seal 38 is located inwardly from the annular recess 40 that extends around the rim. This can lid, which is not shown in the drawings, is removed for painting purposes but this lid may be reattached to the can if a usable amount of paint remains in the can after the paint job has been completed.

In the preferred embodiment of the attachment secured to the top of a standard paint can 12 shown in FIGS. 1 to 5, attached to the attachment body 10 is a handle 44 which is pivotally mounted in holes formed in opposite sides of the attachment body 10. Preferably the handle is formed with a special, upwardly projecting dimple 45 that is located centrally and that helps to hold the attachment evenly on a hook support. The handle for carrying the can is pivotal from a container carrying position whereat the apex of the handle extends over and across the can opening (best shown in FIGS. 1 and 3), to a storage position whereat the handle rests against the side wall 16 of the container. The paint can 12 may be fitted with its standard semi-circular handle 55. However, this handle would normally not be used when the attachment body 10 is secured to the top of the can.

Figure 2:
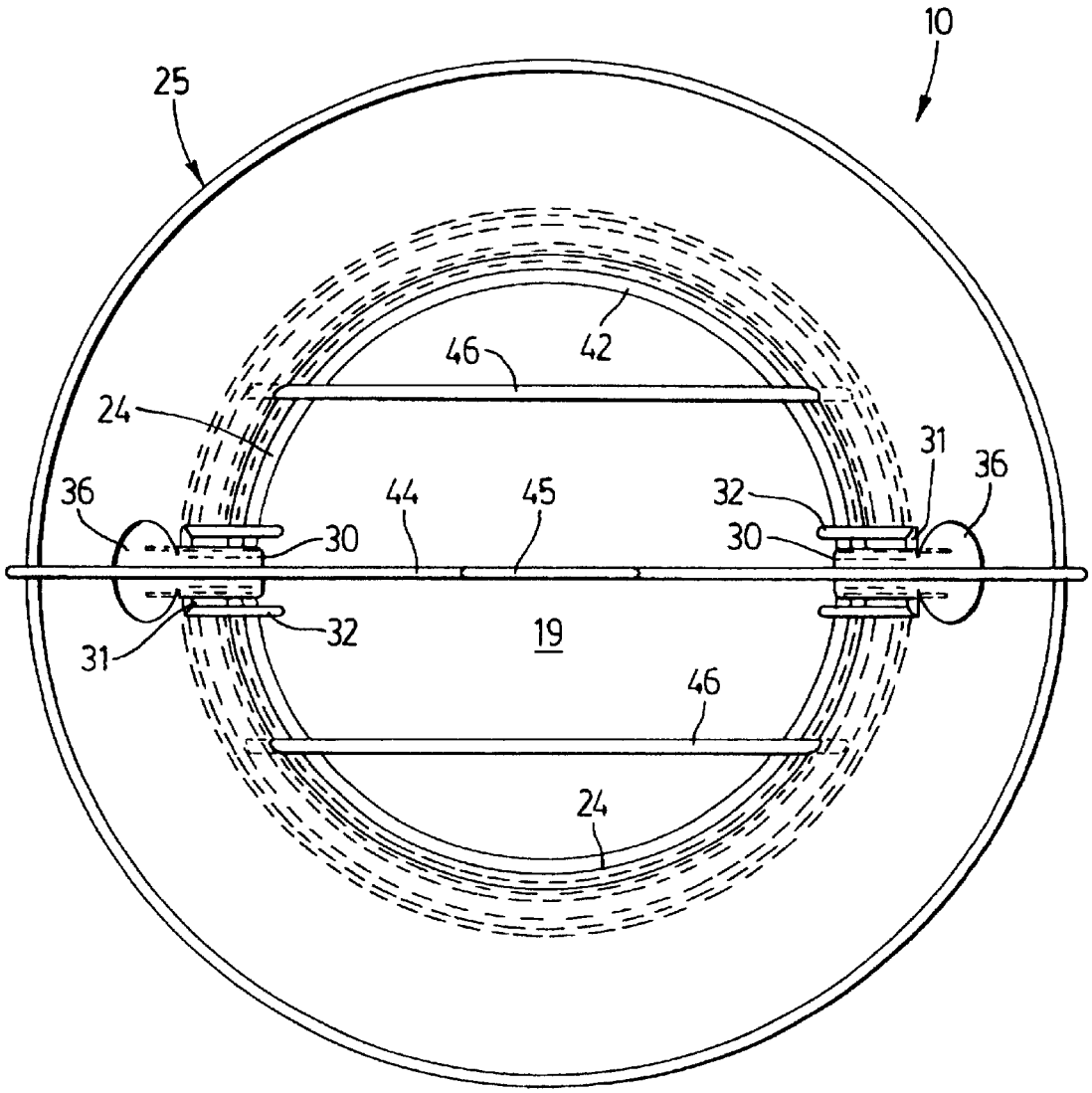
FIG. 2 is a top view of the preferred embodiment of the attachment of the invention.

As can be seen in FIGS. 1 and 2, at least one rod member 46, and preferably two parallel spaced apart steel rod members 46 are secured between opposing sides of the inner surface 20 of the attachment body. Each rod extends over the container upper opening 50 and each provides a paint removing edge. These bars or rods can be used by the painter to remove excess paint from the brush bristles and/or to distribute the paint across the surface of the bristles evenly. It will be appreciated that the excess paint scraped off the brush by the rods 46 will simply drop into the can through opening 50. By using these bars, it is no longer necessary to use the edge of the paint can itself for this purpose and thus the presence of these rods greatly assists in keeping the edge of the paint can clean of paint. Preferably these steel rods 46 extend horizontally when the paint can is sitting on a flat surface and can be used to hold a paint brush when the brush is put down during the painting process. The rods 46 may be made of any suitable material and are preferably made of high carbon plated steel.

It will be understood that the attachment body can be made from any suitably strong rigid material such as a rigid and strong plastic material or steel. A suitable plastic for this purpose would be polypropylene or polyethylene.

It is also possible to construct the attachment body without an annular seal 38, if desired. In this case, a tight-fitting connection between the attachment body and the rim can still be achieved by the use of the clip members 26 which can draw the bottom edge portion tightly against the rim and create a form of sealed joint between them.

Although the invention has been described with reference to illustrative embodiments, it is to be understood that the invention is not limited to these precise embodiments, and that various changes and modifications may be effected therein by one skilled in the art. All such changes and modifications are intended to be encompassed in the appended claims.

I claim:

1. An attachment for a container for storing liquid, said container having a bottom and a peripheral side wall extending upwardly from the bottom to an upper peripheral annular rim that projects horizontally inwardly and defines a container upper opening, said attachment comprising:

an attachment body having an inner surface, an outer surface and a bottom edge portion engagable with the annular rim, said attachment body extending upwardly and outwardly from said bottom edge portion to an upper edge of the body; and releasable fastener means for connecting said attachment body to said rim by engaging of said rim from below and releasably locking said attachment body to said rim in a tight-fitting manner, thereby allowing said liquid to be poured out via said attachment during use of the attachment, said fastener means being mounted on said attachment body and located substantially within said attachment body.

2. An attachment as recited in claim 1 wherein said fastener means includes at least one clip member pivotally secured to the attachment body, said at least one clip member pivotal between a locking position where said at least one clip member is able to securely latch the attachment body to said rim in said tight-fitting manner during use thereof, and a release position where said rim and attachment body can be separated.

3. An attachment as recited in claim 2 wherein said at least one clip member is pivotally secured to the inner surface of said attachment body and includes a latch member, which engages the bottom of said rim during use of said attachment.

4. An attachment as recited in claim 2, wherein the at least one clip member comprises a clip body pivotally mounted on a support bracket fixedly mounted on the inner surface of the attachment body, and a clip latch extending downwardly from the clip body in said locking position and pivotally connected to the clip body, said clip latch firmly engaging the annular rim from below and thereby securing said attachment body to said rim during use of said attachment.

5. An attachment as recited in claim 3 wherein said clip latch includes a hooked bottom end portion that bends outwardly and said annular rim includes a downwardly disposed flange under which said hooked bottom end portion is positioned when said clip member is in said locking portion and said attachment is in use.

6. An attachment as recited in claim 5, wherein said clip latch is formed of a steel wire having a U-shaped bend in a lower portion of the clip latch end and two terminal ends at its upper end, each terminal end secured to the clip body, and wherein said clip latch extends into an annular groove formed outwardly from said downwardly disposed flange when said clip member is in the locked position and said attachment is in use.

7. An attachment as recited in claim 4 wherein said clip body includes a tab portion at an upper end thereof, said tab being spaced sufficiently inwardly from the inner surface of the attachment body when the clip member is in said locking position, to allow a finger of a user to fit between said inner surface and the tab to pull the tab and move the clip member from said locking position to said release position.

8. An attachment as recited in claim 1 wherein said bottom edge portion of said attachment body includes an annular resilient seal member disposed around said bottom edge portion, said seal member sealingly engaging the rim to form an annular seal during use of said attachment.

9. An attachment as recited in claim 8 wherein said seal member is a rubber o-ring.

10. An attachment as recited in claim 2 wherein the bottom edge portion of the attachment body forms an annular skirt arranged to extend inwardly of and below an upper edge of the annular rim during use of said attachment.

11. An attachment as recited in claim 1 wherein a handle for carrying said attachment and the container is pivotally mounted on opposite sides of the attachment body, pivotal from a container carrying position whereat the apex of the handle extends the center of the attachment, to a storage position whereat the handle rests below the upper edge of the attachment body.

12. An attachment as recited in claim 2 wherein at least one rod member is secured to the inner surface of the attachment body and extends over a hole defined by said bottom edge portion, said at least one rod member being adapted to scrape off excess paint from a paint brush for redeposit into said container when said attachment is used during a painting operation.

13. An attachment as recited in claim 12 wherein said at least one rod member comprises two spaced apart steel rods secured between opposing sides of the inner surface of the attachment body.

14. An attachment as recited in claim 2 wherein said attachment body is an annular rigid plastic body forming a circular hole substantially equal in size to said container upper opening.

15. An attachment as recited in claim 2 wherein said attachment body is an annular steel body forming a circular hole substantially equal in size to said container upper opening.

16. A pouring device for a liquid container having an opening in a top of said container, said opening being surrounded by an inwardly projecting rim of said container, said pouring device comprising:

an annular body having an inner surface, an outer surface, and a bottom edge portion tightly engageable with said rim of the container during use of the pouring device, said annular body sloping upwardly and outwardly from said bottom edge portion to an upper edge of the body; and releasable clip members movably mounted on said annular body and adapted to connect said annular body to said rim so that said bottom edge portion tightly engages said rim when said pouring device is used, wherein, when said pouring device is attached to said container, liquid can be poured from said container via said pouring device.

17. A pouring device according to claim 16 wherein each clip member comprises a clip body pivotally mounted on a support bracket fixedly attached on said inner surface of the annular body and a clip latch extending downwardly from the clip body in a connecting position of the clip member and pivotally connected to said clip body, said clip latch engaging said rim of the container from below in said connecting position.

18. A pouring device according to claim 16 including at least one rod member secured to said inner surface of the annular body at opposite ends of the at least one rod member, wherein said at least one rod member extends substantially parallel to a plane defined by said upper edge of the annular body and provides means for removing excess paint from a paint brush.

19. A pouring device according to claim 16 including a handle for carrying both said pouring device and an attached liquid container, said handle being pivotally mounted at opposite ends thereof to said annular body, said handle having an upwardly projecting dimple formed at the centre of the handle.

20. A pouring device according to claim 16 wherein said bottom edge portion includes an annular seal member which is located so as to engage a top of said rim in a sealing manner during use of said pouring device and thereby help to prevent liquid from said container entering into an annular, open-topped recess formed in said rim.

* * * * *